US005393143A

United States Patent [19]

Muhs

[11] Patent Number: 5,393,143

[45] Date of Patent: Feb. 28, 1995

[54] BAG AND METHOD OF MAKING THE SAME

[75] Inventor: Jeffrey D. Muhs, St. Ames, Iowa

[73] Assignee: American Packaging Corporation, Philadelphia, Pa.

[21] Appl. No.: 931,848

[22] Filed: Aug. 19, 1992

[51] Int. Cl.[6] ..... B65D 33/06

[52] U.S. Cl. ..... 383/21; 383/111; 383/121.1

[58] Field of Search ..... 383/121.1, 121, 21, 383/111, 113; 493/226

[56] References Cited

U.S. PATENT DOCUMENTS

| | | | |
|---|---|---|---|
| 1,733,219 | 10/1929 | Duvall | 383/21 |
| 2,210,937 | 8/1940 | Geimer | 383/21 X |
| 2,619,801 | 12/1952 | Evans | 383/111 X |
| 3,851,814 | 12/1974 | Stage | 229/3.5 MF |
| 3,958,749 | 5/1976 | Goodrich | 383/111 X |
| 4,088,264 | 5/1978 | Vogt | 383/111 |
| 4,148,431 | 4/1979 | Lepisto | 383/21 X |
| 4,864,090 | 9/1989 | Maxwell et al. | 383/21 X |
| 5,281,027 | 1/1994 | Thrall | 383/111 X |

*Primary Examiner*—Allan N. Shoap
*Assistant Examiner*—Christopher McDonald
*Attorney, Agent, or Firm*—Frank A. Follmer

[57] ABSTRACT

A bag construction comprising an outer bag and an inner bag contained therewithin and a method of making the same is described. The bag construction is made from a tube length having inner and outer portions, by cross sealing the inner portions and folding the outer portions into a rectangular shaped bottom. A patch is attached to the bottom folds to cover the same and provide an added moisture and vapor barrier.

15 Claims, 6 Drawing Sheets

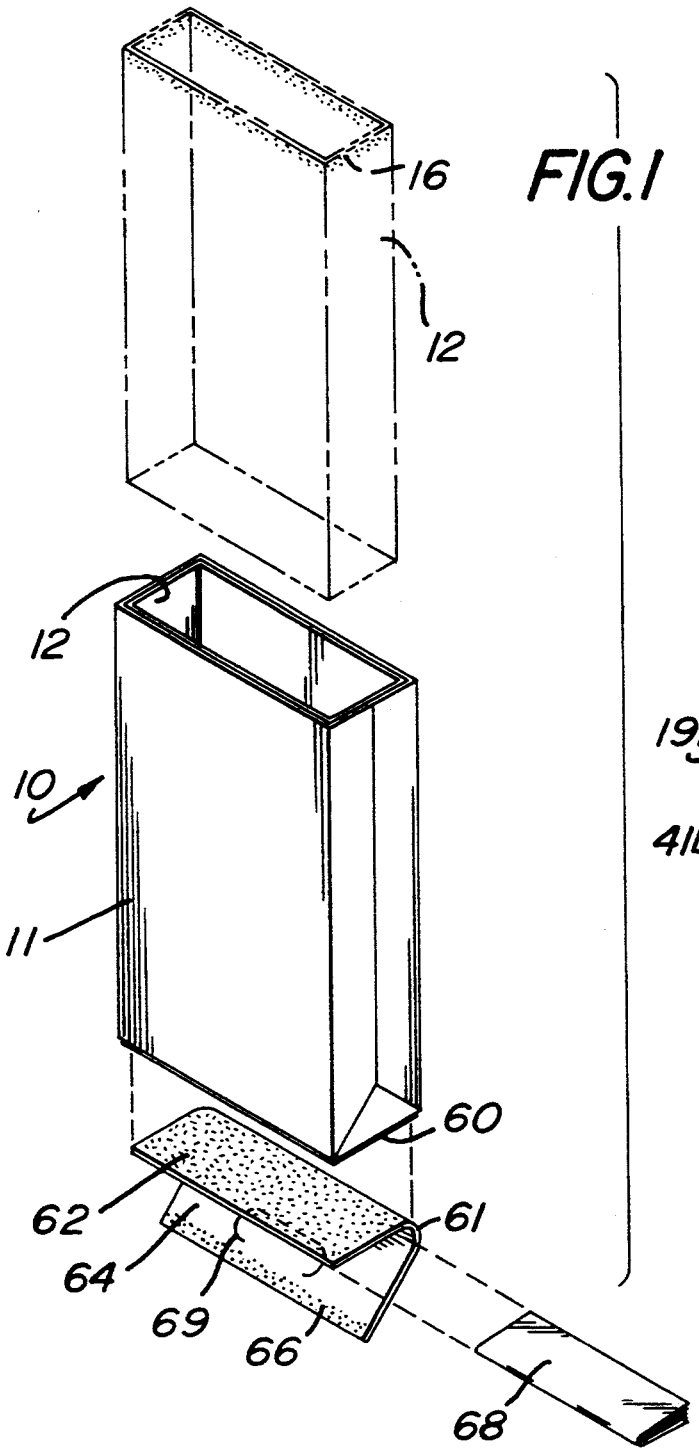
FIG.1
FIG.9
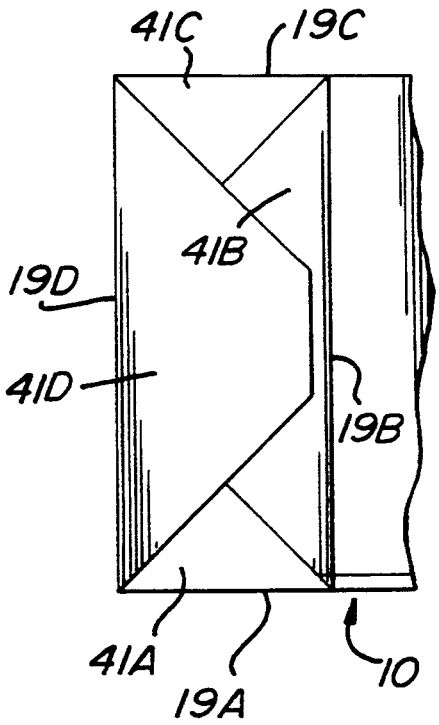

FIG.13
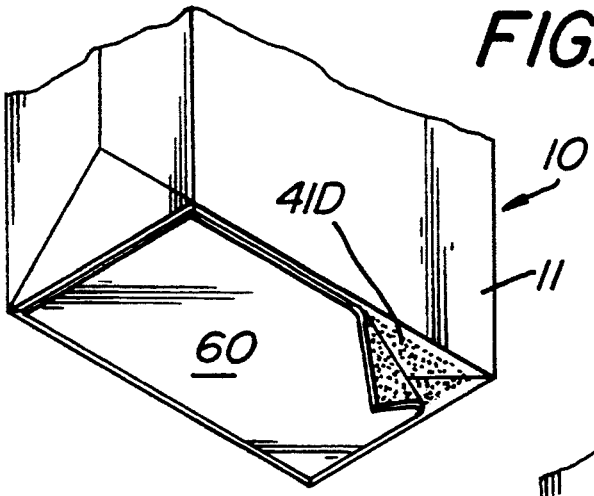
FIG.14
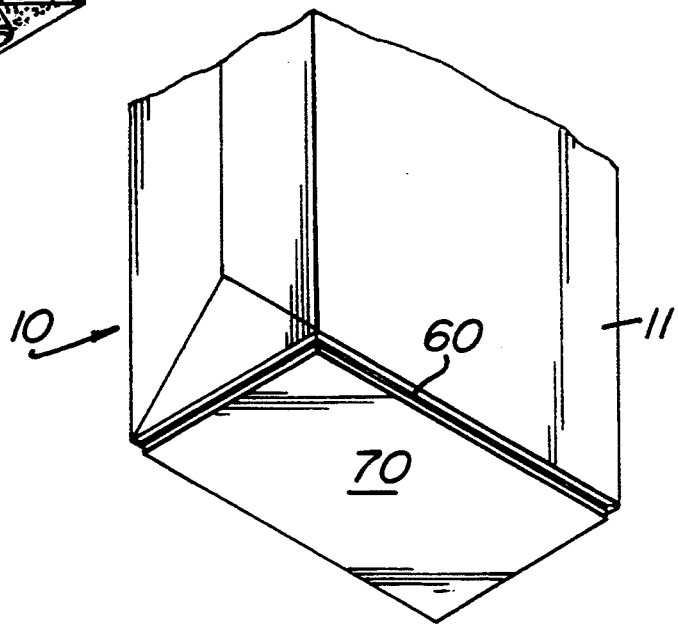
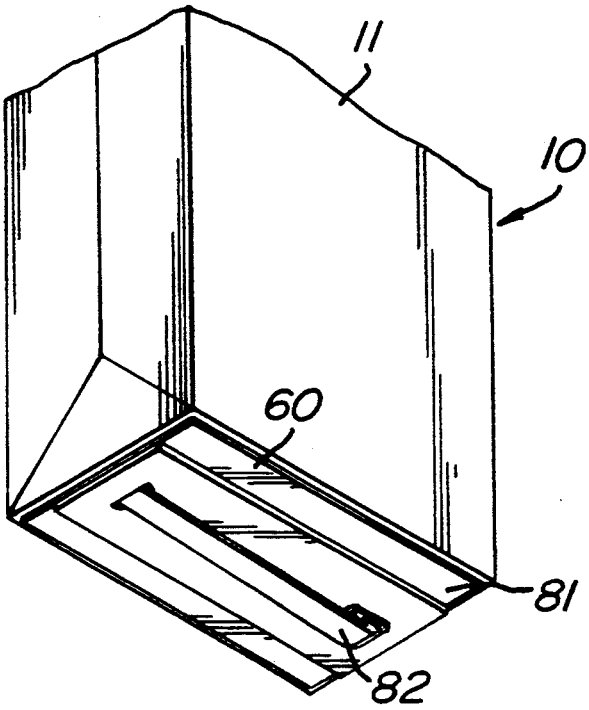
FIG.15

BAG AND METHOD OF MAKING THE SAME

BACKGROUND OF THE INVENTION

1. Field of the Invention

This invention relates generally to bags and methods of making the same and, more particularly, to bags of the leakproof type having an automatic or self opening bottom construction.

2. Description of the Prior Art

Bags of the indicated type are disclosed in U.S. Pat. Nos. 2,496,796, 3,017,069, 3,342,402, 4,490,131, and 4,496,674. As disclosed in these patents, bags of this type generally comprise an outer sheet of paper and an inner liner of an impervious heat sealable material such as a plastic (synthetic resin). The bag is made of a tube and the bottom end of the bag is formed by making a diamond fold comprising a triangular fold portion and a partly rectangular tab fold portion. After the triangular fold portion and tab fold portion are sealed, the bottom of the bag is completed by folding over the tab fold portion onto a previously folded over triangular fold portion. The tab fold portion is caused to adhere to the bottom of the bag by applying suitable adhesive between the contiguous faces of the tab fold portion of the bag bottom structure. During this bottom forming procedure, the bag and the liner are in contiguous overlapping relation so as to form a single bottom structure having a two-ply configuration.

While the prior art bags can be effectively sealed so that the bag can contain many materials without any seepage through the bag bottom, the achievement of a good bottom seal can be attained only by the use of special sealing techniques.

SUMMARY OF THE INVENTION

It is the general object of the present invention to provide a bag construction which comprises an outer bag and an inner bag contained within the outer bag and formed as an independent unit from said outer bag.

A further object of the invention is to provide a bag comprising an outer bag and an inner bag and a method of making the same whereby the bottom of the bag will be effectively sealed against-leakage so that the contents of said bag will be maintained in good condition without loss or deterioration by reason of sifting or breathing through breaks or openings in the bottom seal.

In accordance with another object of the present invention, there is provided a construction whereby the leakproof inner bag unit is adhered to the outer bag in a manner such that the inner bag can be removed easily from the outer bag for disposal purposes.

In pending application Ser. No. 685,476, filed Apr. 12, 1991, there is disclosed a bag of the above-indicated type for achieving the above-described objects. It is a further object of the present invention to provide a bag of this type which is provided with various bottom patch designs that enhance the use and function of the bag. The bottom patch designs are attached to the bottom of the bag to provide an additional moisture and vapor barrier. One bottom patch design provides a pocket for containing an insert that is placed therein. Another bottom patch design provides a handle means to aid in removing the inner bag from the outer bag for disposal purposes.

BRIEF DESCRIPTION OF THE DRAWINGS

FIG. 1 is a perspective view showing the bag construction in accordance with the invention in an open condition to illustrate the various components of the bag construction.

FIG. 9 is a plan view illustrating the subsequent step in the formation of the bag bottom in accordance with the invention.

FIG. 13 is a perspective view of the bottom of a bag showing another patch design in accordance with the invention.

FIG. 14 is a perspective view of the bottom of the bag showing another patch design in accordance with the invention.

FIG. 15 is a perspective view of the bottom of a bag showing another patch design in accordance with the invention.

DETAILED DESCRIPTION OF THE PREFERRED EMBODIMENT

Figure 2:
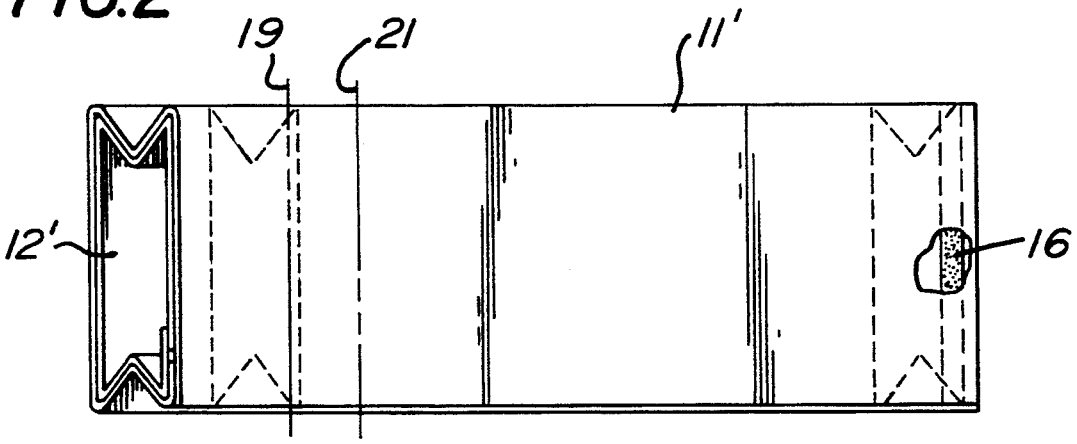
FIG. 2 is a view of a tube length from which the bag construction in accordance with the invention is made.

The method of making the bag in accordance with the invention will be performed in a manner and on equipment similar to that described in the above-listed patents, the essential difference being that the bag construction in accordance with the invention comprises a leakproof inner bag within an outer bag, said inner bag having an independent unitary construction.

The bag in accordance with the invention is indicated generally at 10, and is shown in an open condition in FIG. 1. The bag 10 comprises an outer bag 11 made of a sheet of paper, or other suitable material of requisite strength, and an inner bag 12 preferably made of a sheet of material impervious to the passage of air, vapor, or moisture, but which is sufficiently fusible upon the application of heat to cause the abutting faces thereof to adhere to each other to provide a seal. Thus, inner bag 12 may be made of a heat sealable plastic (synthetic resin). Alternatively, the inner bag 12 may be made of a paper with a heat sealable adhesive coating or other standard materials which are either heat sealable or have a heat or cold seal adhesive added to the mating seal surfaces.

As is shown in the Drawings, the inner bag 12 is an independent unit from the outer bag 11. Also, the inner bag 12 has its bottom end formed to be independent of and to be located adjacent to the bottom of the outer bag 11. Further, as will be described more fully hereafter, means are provided for securing the inner bag 12 to the outer bag 11 in an overlapping relationship, said means including adhesive applied in a manner whereby the inner bag 12 can be easily separated from the outer bag 11 for disposal purposes. Briefly stated, the inner bag 12 is adhered to the outer bag 11 only at the top of the bag 10 to enable the filling thereof.

In the method of making the bag in accordance with the invention an initial step is to form a tube such as that shown in FIG. 2 having an outer tube 11' of paper and an inner tube 12' of an impervious, heat sealable plastic (synthetic resin) whereby the bag may be sealed against outside air and moisture by the heat sealing of the inner tube 12' in a manner in accordance with the invention to be described hereafter. The tube forming may be performed on available automatic bag making machines wherein a web of the material for forming the outer tube 11' and a web of the material for forming the inner tube 12' are fed from rolls in overlapping relationship and then folded together and cut into a tube length of the bellows-fold type, as shown in FIG. 2. As the web of material forming the outer tube 11' is fed to the tube forming machine, an adhesive bar is applied thereto to provide a band 16 for securing the tubes 11' and 12' together and to serve as adhesive means for attaching the inner bag 12 to the outer bag 11. Adhesive band 16 is constructed and arranged so as to hold the plastic material forming the inner bag 12 in its intended place during the operations for forming the bag bottom and so as to enable the filling of the product without delamination. Further, the adhesive band 16 is constructed and arranged such that the inner bag 12 and the outer bag 11 can be easily separated for disposal thereof. Each adhesive band 16 is located just adjacent the line where the tube will be cut off to form the top end of the bag 10 in the final construction. As is conventional, the tube length is passed by a score cylinder which creases it along fold line 19 and a second fold line 21 as the tube length is fed to the bottom forming operation as will be described hereafter, which creasing determines the lines of fold during the bottom forming of the outer bag 11.

At the tube forming machine, the tube is formed by using a heater at the former to create a heat seal 22 at the longitudinally extending seam of the inner tube 12'. This heat seal is produced on the inner tube 12' only whereby the heat sealable material forming the inner tube 12' will not stick to the paper forming the outer tube 11' but will only stick to itself. The outer tube 11' is also secured along a longitudinally extending seam by means of an adhesive 23 applied between overlapping edge portions thereof as is conventional in the tube forming machines in use today. The condition of the bag structure after it has passed through the tube former is that the tube is in a continuous uncut form and it has been formed from a flat web into a tube having gusseted sides. At the tube former, draw rollers pull the webs of outer and inner tube forming material through the former creating a tubular configuration which is then fed to a cutter where it is cut off into tube lengths to provide a tube structure as shown in FIG. 2.

Figure 3:
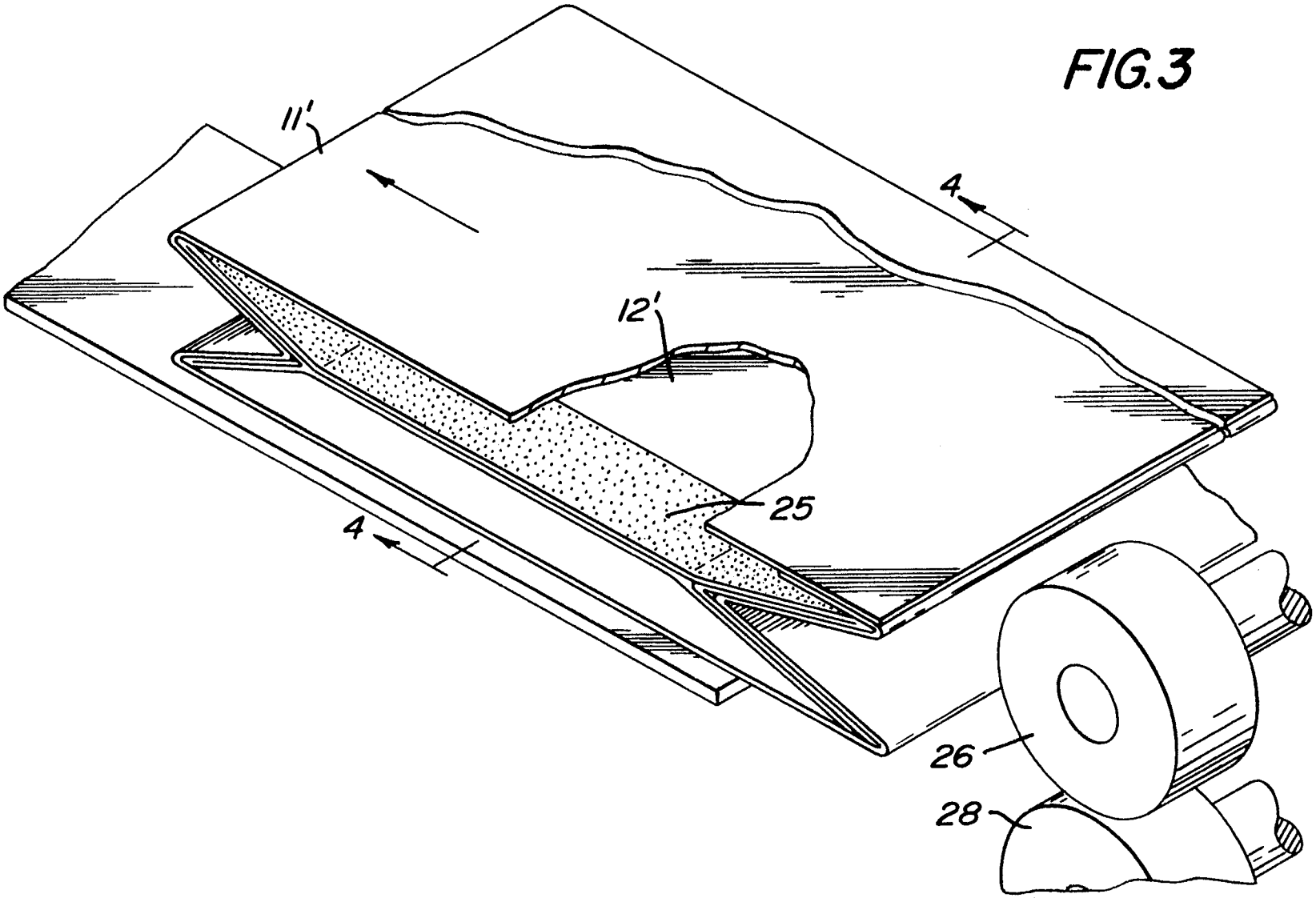
FIG. 3 is a perspective view illustrating the step in accordance with the invention whereby a cross seal is formed to close the bottom end of the inner bag of the bag construction in accordance with the invention.

The next step in the method in accordance with the invention is to advance each cut off tube length to a cross sealing area where at a pressure and heat seal will be applied across the edge of the tube length that is to be located at the bottom end of the bag to form a cross seal 25 on the inner tube 12'. This step is illustrated in FIG. 3 which shows the tube length after the cross seal 25 has been formed, with the end being opened to provide a clearer view of the construction. As shown in FIG. 3, the cross seal 25 is located at the bottom end of the inner tube 12' and has a substantial width, which will vary depending on the size of the bag. The cross sealing step is achieved by feeding the tube length sideways in the direction of the arrow as shown in FIG. 3. As the tube lengths are fed along a conveyor toward the pair of pressure rollers 26 and 28, heat is applied to the bottom edge thereof to cause the heat sealable material of the inner tube 12' to soften and begin to melt and stick to itself. In the final stage of the cross sealing step, the tube length is fed between pressure rollers 26 and 28 which press the contiguous portions of the inner tube 12 together to form the cross seal 25. As shown in FIG. 3, cross seal 25 closes all contiguous portions of the inner tube 12', including the center area and the two gussets at the outer ends of the center area. This provides a very effective seal across the bottom end of the inner tube 12' which will be formed into the inner bag 12 as will be described hereafter.

At the conclusion of the cross sealing step, it will be apparent that the inner tube 12' is now effectively sealed by means of two seals, namely, the longitudinally extending seam seal 22, which is formed during the tube formation at the tube former, and the cross seal 25 which extends transversely to seam seal 22 across the bottom end of the inner tube 12'. It is noted that both the seam seal 22 and the cross seal 25 are formed simply and effectively by conventional and reliable sealing means.

Figure 4:
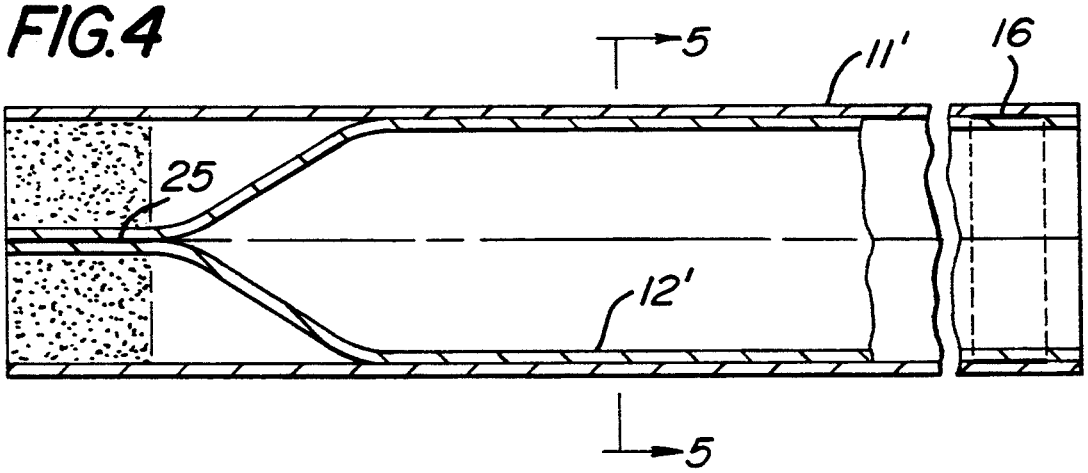
FIG. 4 is a section taken generally on line 4—4 of FIG. 3.
Figure 5:
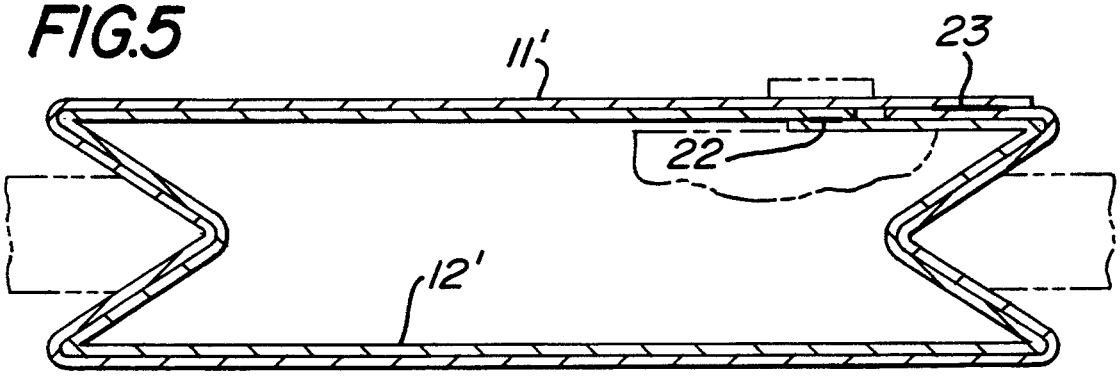
FIG. 5 is a section taken generally on line 5—5 of FIG. 4.

At this stage in the bag making method in accordance with the invention, the inner tube 12' is sealed at its bottom end by cross seal 25 and is secured to the inner wall of the outer tube 11' at a single band of adhesive 16 that extends completely around the tubular structure. As is illustrated in FIGS. 3 and 4, the bottom forming portion of inner tube 12' is not attached in any way to the bottom forming portion of the outer tube 11' whereby the bottoms of the outer bag 11 and the inner bag 12 can be formed to be independent of one another.

The next step in the method in accordance with the invention is to advance the tube length lengthwise to the bottom forming area where the scoring to form fold lines 19 and 21 and the bag bottom opening will be performed. In this step, the tube length is passed between a score cylinder and a cooperating cylinder as it passes to an opening cylinder and drum which cooperates therewith for performing a bottom opening procedure. As is conventional, score cylinder carries blades which, as the cylinder rotates, contact the tube length to crease it transversely to provide fold lines 19 and 21 for the subsequent folding procedure which will occur during the bottom forming step.

The next step in the method is to form the bottom of the bag construction. In the initial stages of this step, the bottom of the outer tube 11' is opened in preparation for folding down the flaps thereof that are located beyond the fold line 19. As discussed above, in accordance with the invention, the bottom of the inner bag 12 will be formed to be an independent structure from the bottom of the outer bag 11. For example, a procedure such as that disclosed in said above-mentioned pending application may be used. In such a procedure, the bottom of the outer tube is opened progressively until it reaches a fully opened position wherein a rectangular figuration is formed defined by four side lines 19A–19D of the fold line 19, said lines being shown in FIG. 6, for example. Also, the bottom portion of the inner tube 12' is placed in the condition to permit the safe inward tucking of the four flap portions 41A–D that form the bottom of the outer tube 11' which flap portions are folded on the four side lines 19A–D, respectively, of the fold line 19 in a manner as conventional in the art as described in detail in said prior patents.

Figure 6:
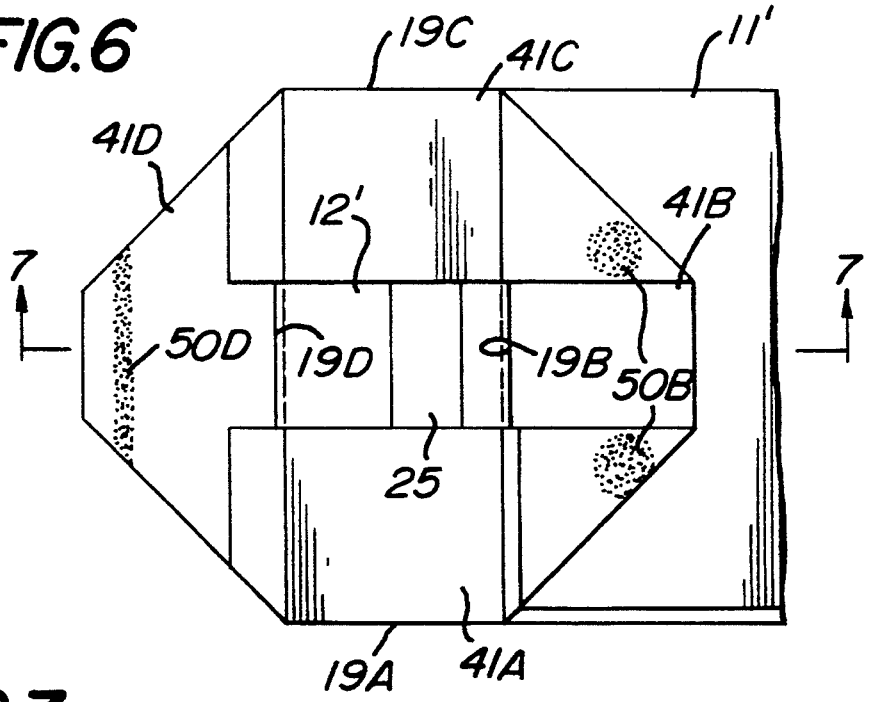
FIG. 6 is a plan view of a later step in the formation of the bottom of the bag construction in accordance with the invention.
Figure 7:
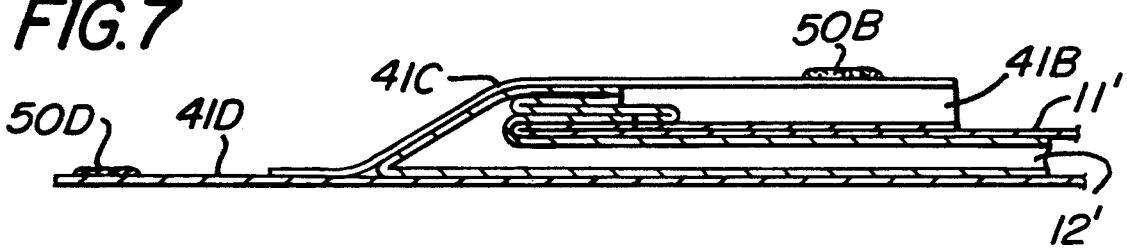
FIG. 7 is a section taken on line 7—7 of FIG. 6.

FIGS. 6–9 illustrate the bottom closing steps as is conventional and as is described in said prior patents. As shown in these figures, and as is described in said prior patents, this procedure involves folding flap portions 41A–D to a flattened condition as shown in FIG. 6 and the application of the deposits of glue or adhesive to suitable parts of the bottom flaps of the outer tube 11' after said tube has been folded to the flattened condition as shown in FIG. 6. Thus, adhesive is applied along areas 50B and 50D of the flap portions 41B and 41D, respectively, as shown in FIG. 6 and is described in detail in said prior patents.

Figure 8:
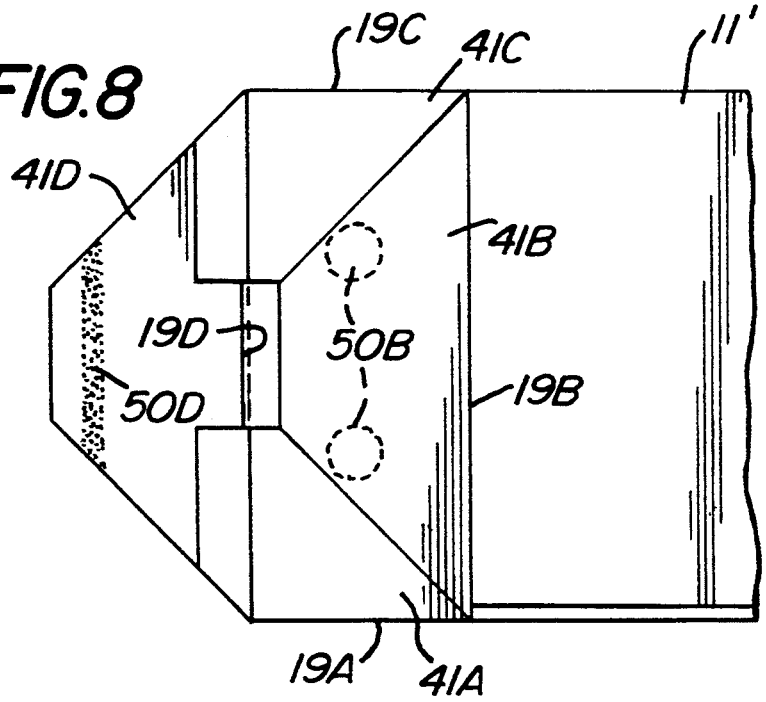
FIG. 8 is a plan view of a later step in the formation of the bottom of the bag construction in accordance with the invention.
Figure 10:
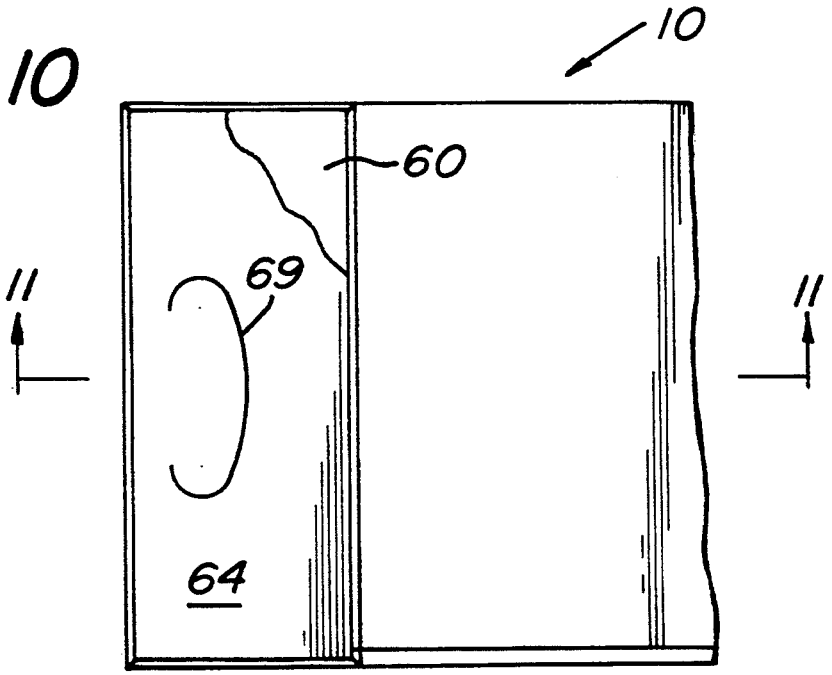
FIG. 10 is a plan view illustrating the completed bag construction in accordance with the patch design in place on the bag bottom.

Referring to FIGS. 8 and 9, in the next steps of the bag closure, the triangular shaped flap portion 41B of the diamond fold is folded over along fold line 19B, and adhered to flap portions 41A and 41C at adhesive areas 50B, after which the triangular shaped flap portion 41D is folded over along fold line 19D onto flap 41B, and adhered thereto at adhesive area 50D, to complete the formation of the bottom of the outer bag 11 as shown in FIG. 9. Again, this procedure is described in detail in the prior mentioned patents. During this latter step, the flap 41D is pressed into contact on top of the flap 41B so that the adhesive area 50D serves to provide attachment therebetween.

Figure 11:
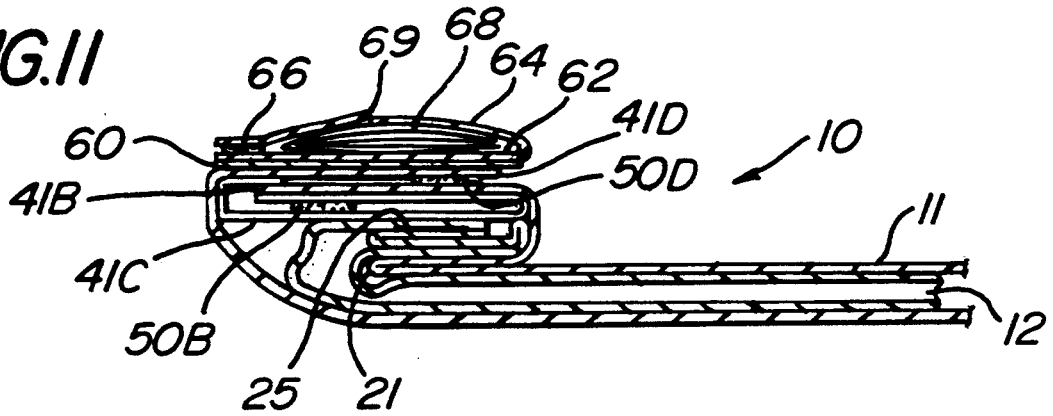
FIG. 11 is a section taken along line 11—11 of FIG. 10, the thickness of the cross-sectioned parts being enlarged for clarity of illustration.

In the next step of forming the bag 10, a rectangular patch means is attached to the rectangular bag bottom to cover the rectangular surface contained within lines 19A–D. To this end, a rectangular patch 60 in the form of a sheet of paper is adhered, as by the use of a suitable glue, throughout its inner surface to the exposed bottom surfaces of flap portions 41A–D. In the embodiment of the invention shown in FIGS. 1–12, the patch means also comprises a pocket-like structure having a pair of flap portions 62 and 64 which are folded over on a fold line 61 at one edge thereof in overlapping relation and are lightly adhered along an adhesive band 66 at the opposite end portions thereof as shown in FIGS. 1 and 11. The inner flap 62 is adhered throughout its inner surface to the top of patch 60 adhered to flap portions 41A–D as described above. By this arrangement, flaps 62 and 64 cooperate to provide a pocket for receiving an insert 68 placed therein and which can be removed. The use of inserts is well known in the art, as is described in U.S. Pat. No. 3,342,402. Many materials which are sold in bags require that instructions or the like, or an envelope containing additional material, such as a pack of seeds, be provided in the form of an insert.

In addition, the outer flap 64 has a C-shaped cutout 69 formed therein to provide a handle means to aid in removing the inner bag from the outer bag during the separation thereof for recycling.

Figure 12:
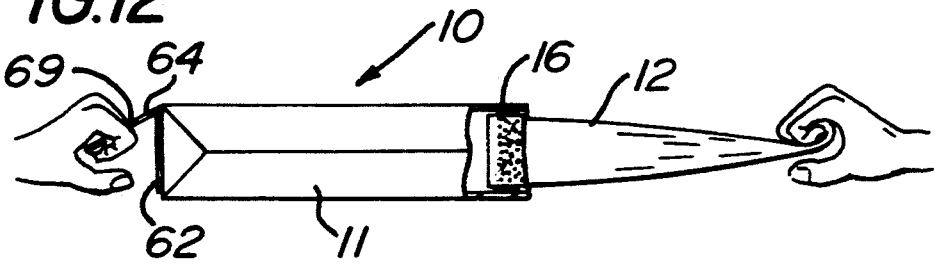
FIG. 12 is a view illustrating the procedure by which the inner bag is removed from the outer bag.

In FIG. 1, the bag 10 is shown in open condition with the bottom being squared up. This figure also illustrates the bag construction in accordance with the invention whereby the outer bag 11 has a separate inner bag 12 contained therein. As shown in this figure, the bag is constructed so that the inner bag is secured to the outer bag at limited regions by a construction including the adhesive band 16 at the top end of the bag 10 whereby inner bag 12 can be easily removed from outer bag 11 for disposal purposes. This separation of the bags 11 and 12 will permit the separate disposal thereof which can be important for recycling purposes since said bags 11 and 12 are made of different materials which are often recycled separately. FIG. 12 illustrates the method by which the bags 11 and 12 can be separated from one another in an easy manner. As shown in this figure, one hand of the customer grasps the inner bag at the bottom thereof and pulls it outwardly away from the bottom end of bag 10 while the other hand of the customer holds the bottom end of the bag 10 by the use of the handle means provided by the cutout 69 in the outer flap 64 of the patch means. It is noted that the outer flap 64 will be removed from its light attachment to the inner flap 62 in order to facilitate the grasping of the handle means of cutout 69 during the separating procedure as illustrated in FIG. 12.

In FIG. 13, there is shown the use of a patch means in the form of a flat rectangular patch formed by a sheet of paper 60, which is adhered throughout its inner surface, as by gluing, to the exposed bottom surfaces of flap portions 41A–D. This is the simplest form of patch means in accordance with the invention and its only function is to provide added moisture and vapor barrier to the bottom of the bag 10.

In FIG. 14, there is shown an embodiment of the invention similar to FIG. 13 except that the patch means 80 comprises both a flat rectangular sheet 60, such as that shown in the FIG. 13 embodiment, and an additional rectangular bottom patch 70 made of a strong rigid construction, either of a plastic or a paperboard material. Rigid patch 70 is adhered by glue throughout its inner surface on top of patch 60. The rigid patch 70 provides the added moisture and vapor barrier in addition to providing a place where the bottom of the bag can be grasped to aid the user in removing the inner bag 12.

FIG. 15 discloses another embodiment invention of the invention wherein the patch means includes, in addition to the flat patch 60 as shown in FIG. 13, a strap handle arrangement comprising a rigid base 81 and a handle 82 secured at the bottom surface thereof and adapted to be grasped by the hand of a user during a separating procedure similar to that shown in FIG. 12 above. Base 81 is adhered by glue throughout its inner surface on top of patch 60.

What is claimed is:

1. A leakproof bag construction formed from a pair of independent tubes arranged one within the other in intimate contact throughout the opposed surfaces thereof comprising an outer bag formed from the outer tube of said pair of tubes, an inner bag formed from the inner tube of said pair of tubes to be contained within said outer bag, said inner bag made of a leakproof material, said outer tube having a portion at its one end forming the bottom of said outer bag, said inner tube having a portion at its one end forming the bottom of said inner bag and located in opposed relation to said outer tube bottom forming portion, said bottom of said inner bag being formed independently of said bottom of said outer bag, means forming a leakproof seal closing said bottom forming portion of said inner bag, and means for securing said inner bag to said outer bag to hold said inner and outer tubes together during the forming of said bottoms of said inner and outer bags and to permit said bags to be easily separated from one another for disposal thereof, and patch means attached to the bottom surface portions of said bottom of said outer bag to provide a moisture and vapor barrier, said patch means having a pocket-like construction and containing a removable insert.

2. A leakproof bag construction according to claim 1 wherein said inner tube has the same dimensions as said outer tube.

3. A bag construction according to claim 1 wherein said means for securing said inner bag to said outer bag comprises an adhesive band located at the top end of the bag construction.

4. A bag construction according to claim 1 wherein said patch means comprises means providing a handle adapted to be grasped for use in separating the inner and outer bags.

5. A bag construction according to claim 1 wherein said patch means comprises a rigid rectangular piece.

6. A leakproof bag construction of the rectangular bottom type, said bag construction being made from a two-ply laminated sheet of material formed into a tube construction comprising outer and inner flat independent tubes of a bellows-fold construction arranged one within the other with the inner surface of said outer tube in intimate contact with the corresponding opposed outer surface of said inner tube, said bag construction comprising an outer bag formed from said outer tube and having sidewalls including a pair of opposed straight walls and a pair of opposed gusseted end walls, an inner bag formed from said inner tube and contained within said outer bag, said inner bag having sidewalls lying adjacent to and in intimate contact with the entire inner surface of the sidewalls of the outer bag and including a pair of gusseted end walls in intimate overlapping contact with said gusseted end walls of said outer tube throughout all of the adjacent corresponding portions thereof, said bag construction having, in its completed condition, a flattened configuration wherein each of said gusseted end walls of said outer and inner bags have a pair of folded together gusseted wall portions in a closed folded together position, each of said gusseted wall portions of said outer and inner bags including a pair of folded together panels, each of said pair of panels of said pair of gusseted wall portions of each end wall of said inner bag being in intimate overlapping contact with a corresponding panel of said pair of panels of said pair of gusseted wall portions of each end wall of said outer bag in said closed folded together position thereof, said outer bag and said inner bag being made of different materials with said inner bag being made of a leakproof material, said outer tube having a bottom portion at its one end forming a rectangular shaped bottom of said outer bag, said inner tube having a bottom portion at its one end forming the bottom of said inner bag and located in opposed relation to said bottom portion of said outer tube, said bottom portions of said outer and inner bags being made from separated ply portions of said laminated sheet formed into said outer and inner tubes, said bottom of said outer bag including a plurality of bottom flaps folded over from said sidewalls of said outer bag to provide a rectangular shaped bottom of said outer bag, said bottom of said inner bag being formed as an independent structure from said bottom of said outer bag and being constructed and arranged to extend across the bag bottom between said sidewalls of said outer bag free of any engagement with said bottom flaps forming said outer bag bottom portion so that all of said bottom of said inner bag is easily moved away from said bottom of said outer bag without disturbing said bottom flaps when said inner bag is to be separated from said outer bag for disposal thereof, means forming a leakproof seal closing said bottom forming portion of said inner bag, said inner bag being held within said outer bag so as to permit said inner and outer bags to be easily separated from one another for the separate disposal thereof with all of the leakproof material comprising said inner bag being separable from the material comprising said outer bag, and patch means attached to said bottom flaps to provide a moisture and vapor barrier, said patch means having a pocket-like construction and containing a removable insert.

7. A leakproof bag construction according to claim 6 wherein said inner tube has essentially the same linear dimensions and cross-sectional configuration as said outer tube.

8. A bag construction according to claim 6 wherein said bottom flaps and said sidewalls of said outer bag define an internal bag chamber for containing said inner bag, all of said bottom forming portion of said inner bag being contained within said bag chamber and being located adjacent said bottom flaps.

9. A bag construction according to claim 6 wherein said patch means comprises means providing a handle adapted to be grasped for use in separating the inner and outer bags.

10. A bag construction according to claim 6 wherein said patch means comprises a rigid rectangular piece.

11. A bag construction according to claim 6 wherein said bottom flaps comprise four flaps arranged to provide a rectangular-shaped bottom configuration.

12. A leakproof bag construction of the flat bottom type formed from a tube construction comprising a pair of flat independent tubes arranged one within the other in intimate contact throughout all of the corresponding opposed surfaces thereof, said tube construction being formed from a two-ply laminated sheet of material, said bag construction comprising an outer bag formed from the outer tube of said pair of tubes, said outer tube having sidewalls, the inner surface of which defines the interior of said outer tube, an inner bag formed from the inner tube of said pair of tubes to be contained within said outer bag, said inner tube having sidewalls lying adjacent to and in intimate contact with the entire inner surfaces of the sidewalls of the outer tube said outer tube and said inner bag being made of different materials with said inner bag being made of a leakproof material, said outer tube having a flat portion at its one end forming a flat bottom of said outer bag, said inner tube having a portion at its one end forming the bottom of said inner bag and located in opposed relation to said outer tube bottom forming portion, said outer bag bottom forming portion including a plurality of bottom flaps folded over from said sidewalls of said outer bag to provide a flat bottom of said outer bag, said bottom of said inner bag being formed as an independent structure from said outer tube bottom and being constructed and arranged to extend across the bag bottom between said sidewalls of said outer bag free of any engagement with said bottom flaps forming said outer bag bottom portion so that all of said bottom of said inner bag is easily moved away from said bottom of said outer bag without disturbing said bottom flaps when said inner bag is to be separated from said outer bag for disposal thereof, means forming a leakproof seal closing said bottom forming portion of said inner bag, said inner bag being held within said outer bag so as to permit said inner and outer bags to be easily separated from one another for the separate disposal thereof with all of the leakproof material comprising said inner bag being separable from the material comprising said outer bag, and patch means attached to said bottom flaps to provide a moisture and vapor barrier, said patch means having a pocket-like construction and containing a removable insert.

13. A bag construction according to claim 12 wherein said bottom flaps and said sidewalls of said outer bag define an internal bag chamber for containing said inner bag, all of said bottom forming portion of said inner bag being contained within said bag chamber and being located adjacent said bottom flaps.

14. A bag construction according to claim 12 wherein said patch means comprises means providing a handle adapted to be grasped for use in separating the inner and outer bags.

15. A bag construction according to claim 12 wherein said patch means comprises a rigid rectangular piece.

* * * * *